US006891093B2

(12) United States Patent
Huang

(10) Patent No.: US 6,891,093 B2
(45) Date of Patent: May 10, 2005

(54) STEPLESSLY ADJUSTABLE SHOULDER REST FOR VIOLIN OR THE LIKE

(75) Inventor: Chin-Yin Huang, Kaohsiung (TW)

(73) Assignee: Jia Chyn Instruments Co., Ltd., Kaohsiung (TW)

( * ) Notice: Subject to any disclaimer, the term of this patent is extended or adjusted under 35 U.S.C. 154(b) by 103 days.

(21) Appl. No.: 10/626,545

(22) Filed: Jul. 25, 2003

(65) Prior Publication Data

US 2005/0016355 A1 Jan. 27, 2005

(51) Int. Cl.[7] ..... G10D 1/02

(52) U.S. Cl. ..... 84/278; 84/279; 84/280; D17/20

(58) Field of Search ..... 84/278, 279, 280; D17/20

(56) References Cited

U.S. PATENT DOCUMENTS 4,333,378 A * 6/1982 Hrdlicka ..... 84/280
D352,053 S * 11/1994 Murray ..... D17/20
5,567,893 A * 10/1996 Kun ..... 84/280
D385,292 S * 10/1997 Kun ..... D17/20
6,291,750 B1 * 9/2001 Farha ..... 84/278

* cited by examiner

*Primary Examiner*—Shih-Yung Hsieh
(74) *Attorney, Agent, or Firm*—Troxell Law Office, PLLC

(57) ABSTRACT

A steplessly adjustable shoulder rest for violin or the like includes an elongated base having two oppositely spaced recesses provided on an upper surface thereof. Two guiding and locking bolts are separately located at and projected from an outer side of a center of the two recesses to engage with long slots on two adjusting slides, so that the adjusting slides are slidably located in said recesses. Outer ends of the two adjusting slides are two vertical end walls, to outer sides of which two binding elements are screwed to move along with the adjusting slides. Two nuts are tightened to or loosened from the two guiding and locking bolts upward projected from the adjusting slides, so the adjusting slides may be steplessly adjusted to desired positions for the binding elements to best fitly connect the shoulder rest to a lower rear end of the violin or the like.

4 Claims, 5 Drawing Sheets

STEPLESSLY ADJUSTABLE SHOULDER REST FOR VIOLIN OR THE LIKE

FIELD OF THE INVENTION

The present invention relates to a steplessly adjustable shoulder rest for violin or the like, and more particularly to a shoulder rest including two spaced binding elements that may be separately steplessly adjusted to reach a desired distance between them, so that the shoulder rest may be conveniently connected to the violin or the like to always meet a width thereof.

BACKGROUND OF THE INVENTION

A violin player would usually rest a rear end of the violin on one shoulder bone to bear one chin against the violin while playing it. To reduce the discomfort at the shoulder area being compressed by a hard body of the violin, it is a common practice to place a shoulder rest at a lower rear end of the violin. Such shoulder rest for violin or the like basically includes an elongated base configured for fitly bearing against the player's shoulder bone, and two spaced binding elements provided at two upper outer ends of the elongated base. The binding elements are separately tightened to outer edges of the violin or the like near the rear end thereof to fixedly connect the shoulder rest to the violin. Meanwhile, since a lower surface of the elongated base is directly pressed against the player's shoulder bone area, it is a common practice to fixedly attach a layer of air-permeable soft pad to the lower surface of the base, so that the shoulder rest is more comfortable for use.

To match with different configurations of violins or the like, as well as players' different preferences, the two spaced binding elements provided on the elongated bases of most currently available shoulder rests have adjusting means assembled thereto in advance, so that the two binding elements may be adjusted to space from each other by different distances depending on the body configuration of the violin or the like and the actual needs in use. Canadian Patent No. 2,262,290 owned by Canadian firm of The Kun Shoulder Rest Inc. discloses two spaced clamping devices for binding and locating purpose. A distance between the two binding and clamping devices may be adjusted corresponding to different widths at the lower rear end of the violin. However, there are usually only a few fixed distances available for such adjustment. For example, two groups of threaded holes are separately provided at two ends of the elongated base of the shoulder rest, and each of the two groups usually includes only three spaced holes. That is, the two binding elements on the shoulder rest may be adjusted to three different positions only. As a matter of fact, such shoulder rest for violin must be so designed that it may also be used with other different types of string instruments. Moreover, the player's preference and possible error in the size of the manufactured violin or other types of string instruments must also be taken into consideration. Therefore, it is apparently insufficient if the shoulder rest has only three fixed adjusting distances available for use.

SUMMARY OF THE INVENTION

A primary object of the present invention is to provide a steplessly adjustable shoulder rest for violin or the like, so that a space between two binding elements on the shoulder rest may be steplessly adjusted to any desired distance and the binding elements may be adjusted to an angular position relative to the shoulder rest when necessary, enabling the shoulder rest to be widely used with various types of violins having different widths, and more fitly connected to the lower rear end of the violin.

To achieve the above and other objects, the shoulder rest for violin or the like according to the present invention mainly includes:

- a substantially elongated base made of a wooden material and having a layer of air-permeable soft pad fixedly attached to a lower surface thereof, the elongated base is provided at an upper surface with two oppositely spaced recesses that are separately extended from two outer ends of the base by a predetermined distance toward a central area of the base, and two guiding and locking bolts are separately provided in the recesses at positions in the vicinity of a middle point of the base but closer to outer ends thereof to vertically project from the upper surface of the base by a predetermined distance;
- two adjusting slides, each of which having a horizontal main body provided with a long slot and adapted to flatly and slidably locate in one recess on the elongated base with the guiding and locking bolt in the recess upward projected via the long slot, and outer ends of the horizontal main bodies are formed into two vertical end walls;
- two nuts for screwing to or loosening from the guiding and locking bolts; and
- two binding elements separately connected to outer sides of the horizontal end walls of the two adjusting slides to move along with the adjusting slides.

In a preferred embodiment of the present invention, one of the two recesses on the upper surface of the base is extended from one outer end of the base toward an inner edge of the base facing toward a player, and the other recess is extended from the other end of the base toward an outer edge of the base facing away from the player, so that a relatively long distance is available for the stepless adjustment of the adjusting slides and accordingly the binding elements.

In a most preferable embodiment of the present invention, the vertical end walls of the two adjusting slides are separately formed at an outer side with a threaded hole for engaging with a rotational nut having a radial threaded hole provided thereon, and the two binding elements are connected at respective downward extended screw bar to the radial threaded holes on the rotational nuts to effectuate stepless angular adjustment of the binding elements relative to the base of the shoulder rest.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
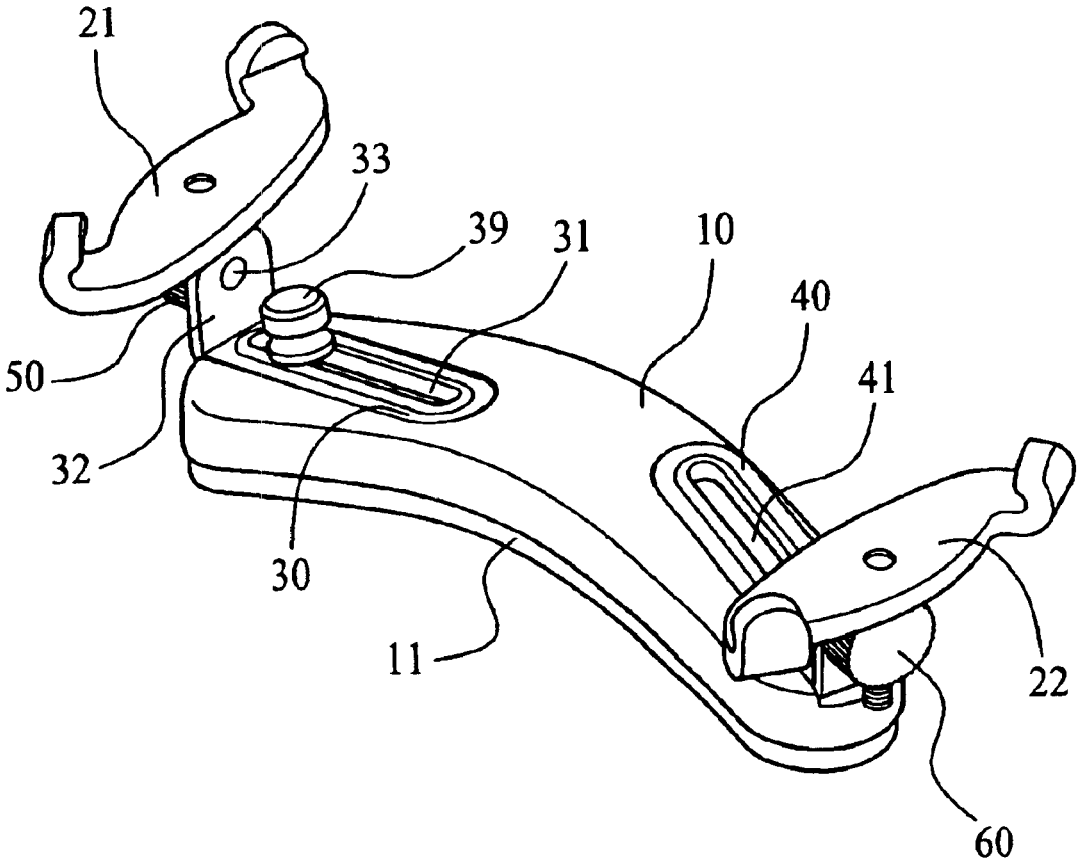
FIG. 1 is a fully assembled perspective view of a steplessly adjustable shoulder rest for violin or the like according to a preferred embodiment of the present invention.

Please refer to FIG. 1 that is a fully assembled perspective view of a shoulder rest for a violin or the like according to a preferred embodiment of the present invention. As shown, the shoulder rest includes a substantially elongated base 10 made of a wooden material, and a layer of air-permeable soft pad 11 fixedly attached to a lower surface of the base 10. The elongated base 10 is provided at two upper outer ends with two spaced binding elements, namely, a first and a second binding element 21, 22. In the illustrated embodiment, the first and the second binding element 21, 22 are separately assembled to outer ends of two adjusting slides 30, 40 movably mounted on the elongated base 10.

Figure 2:
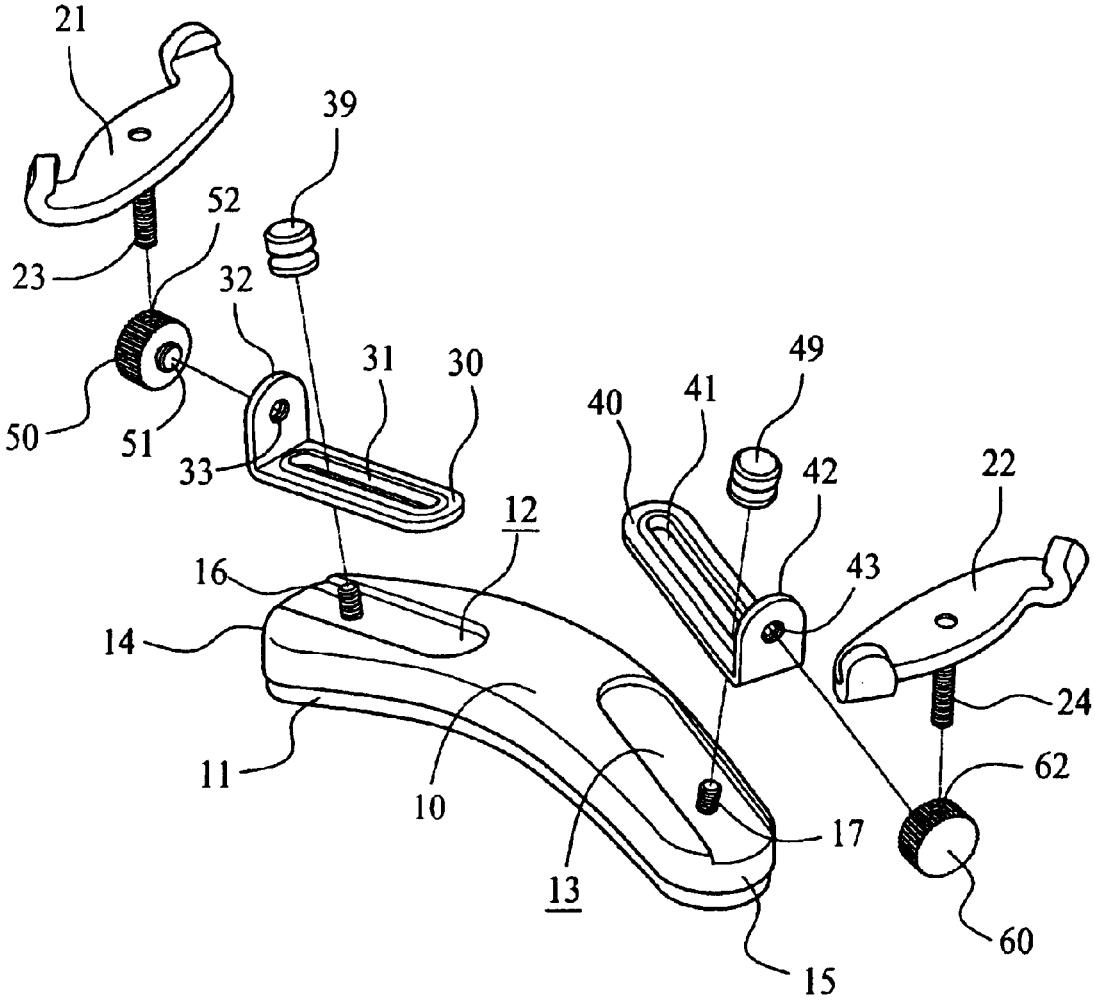
FIG. 2 is an exploded perspective view of FIG. 1.
Figure 3:
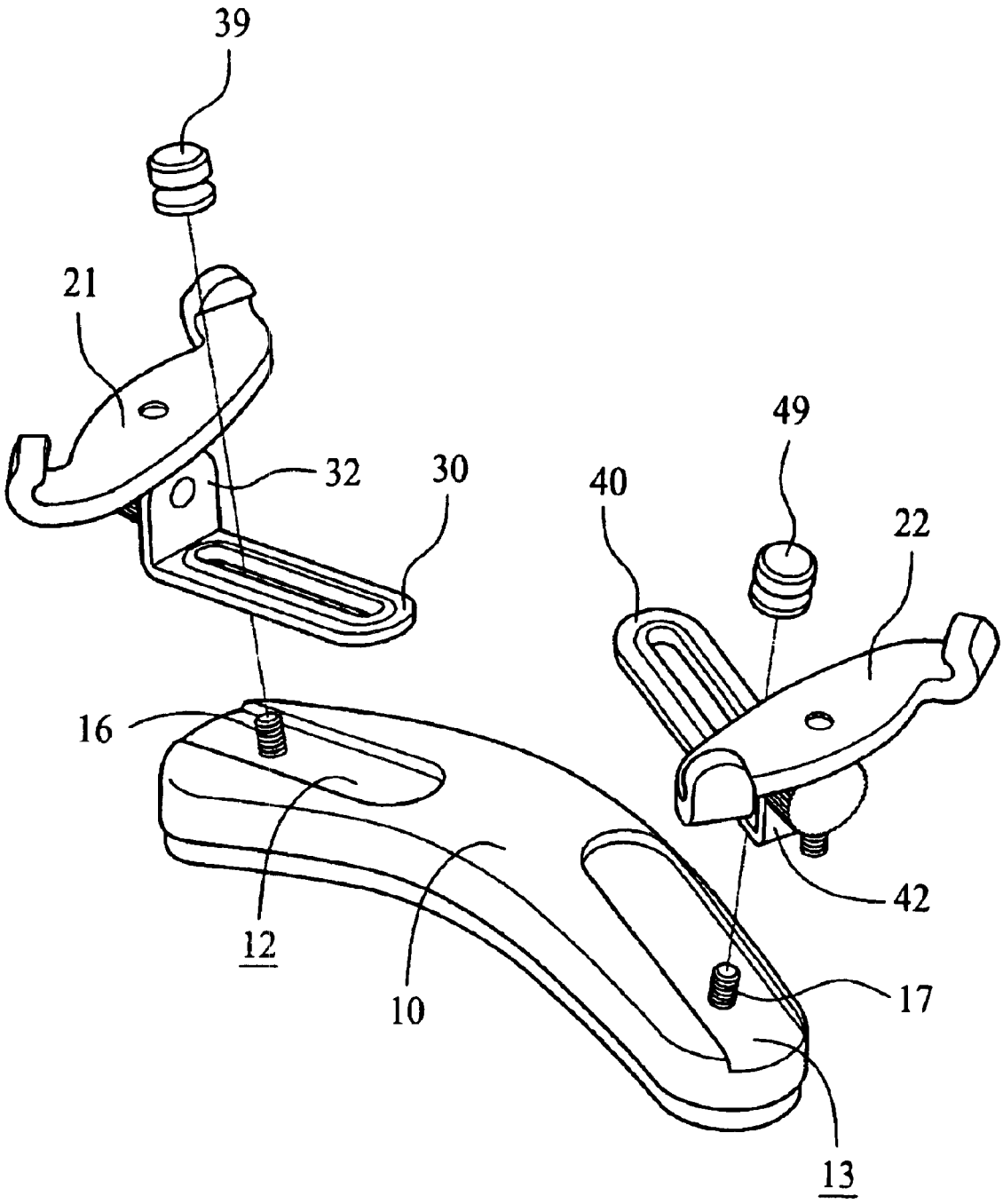
FIG. 3 is a partially assembled view of FIG. 2.

As can be seen in FIGS. 2 and 3 that are fully exploded and partially assembled perspective views, respectively, of the shoulder rest of the present invention, the elongated base 10 is provided on an upper surface with two oppositely spaced recesses 12, 13. In the illustrated preferred embodiment, the two recesses 12, 13 are separately extended from two outer ends 14, 15 toward a central area of the base 10 by a predetermined distance. More specifically, to match with an overall configuration of the base 10, one of the two recesses 12 is extended from one end 14 of the base 10 toward an inner edge of the base 10 facing toward a player, while the other recess 13 is extended from the other end 15 of the base 10 toward an outer edge of the base 10 facing away from the player. Two guiding and locking bolts 16, 17 are provided in the recesses 12, 13, respectively, at positions in the vicinity of a center of the recesses 12, 13 but closer to outer ends thereof to vertically project from the upper surface of the base 10 by a predetermined distance.

The two adjusting slides 30, 40 respectively include a horizontal main body which preferably have a length equal to a full length by which the recesses 12, 13 extend from the outer ends to the central area of the base 10. Whereby, when the two binding elements 21, 22 are adjusted to have a shortest distance between them, the horizontal main bodies of the adjusting slides 30, 40 are completely received in the two recesses 12, 13 with their outer ends flush with the outer ends 14, 15 of the base 10. The horizontal main bodies of the two adjusting slides 30, 40 have a thickness equal to a depth of the two recesses 12, 13 and therefore have top surfaces flush with the upper surface of the base 10. The horizontal main bodies of the two adjusting slides 30, 40 are respectively preformed with a long slot 31, 41 having a width slightly larger than a diameter of the bolts 16, 17 for the latter to locate therein and upward project therefrom. Outer ends of the main bodies are formed into two vertical end walls 32, 42 respectively having a threaded central hole 33, 43.

After the two adjusting slides 30, 40 are assembled to the recesses 12, 13 on the base 10 with the bolts 16, 17 upward extended through the long slots 31, 41, two nuts 39, 49 are separately screwed to the projected bolts 16, 17 to thereby lock the two adjusting slides 30, 40 in place. When the two nuts 39, 49 are loosened, the two adjusting slides 30, 40 may be slid along the long slots 31, 41 to desired assembling positions relative to the base 10.

Two rotational nuts 50, 60 are rotatably connected to an outer side of the two vertical end walls 32, 42 of the two adjusting slides 30, 40 by means of extending their respective screw rod portion 51 through the threaded central holes 33, 43 on the end walls 32, 42. The two rotational nuts 50, 60 are provided on their respective circumferential surface with a radially extended threaded hole 52, 62 for engaging with two screw bars 23, 24 extended from a lower side of the two binding elements 21, 22, respectively.

Figure 4:
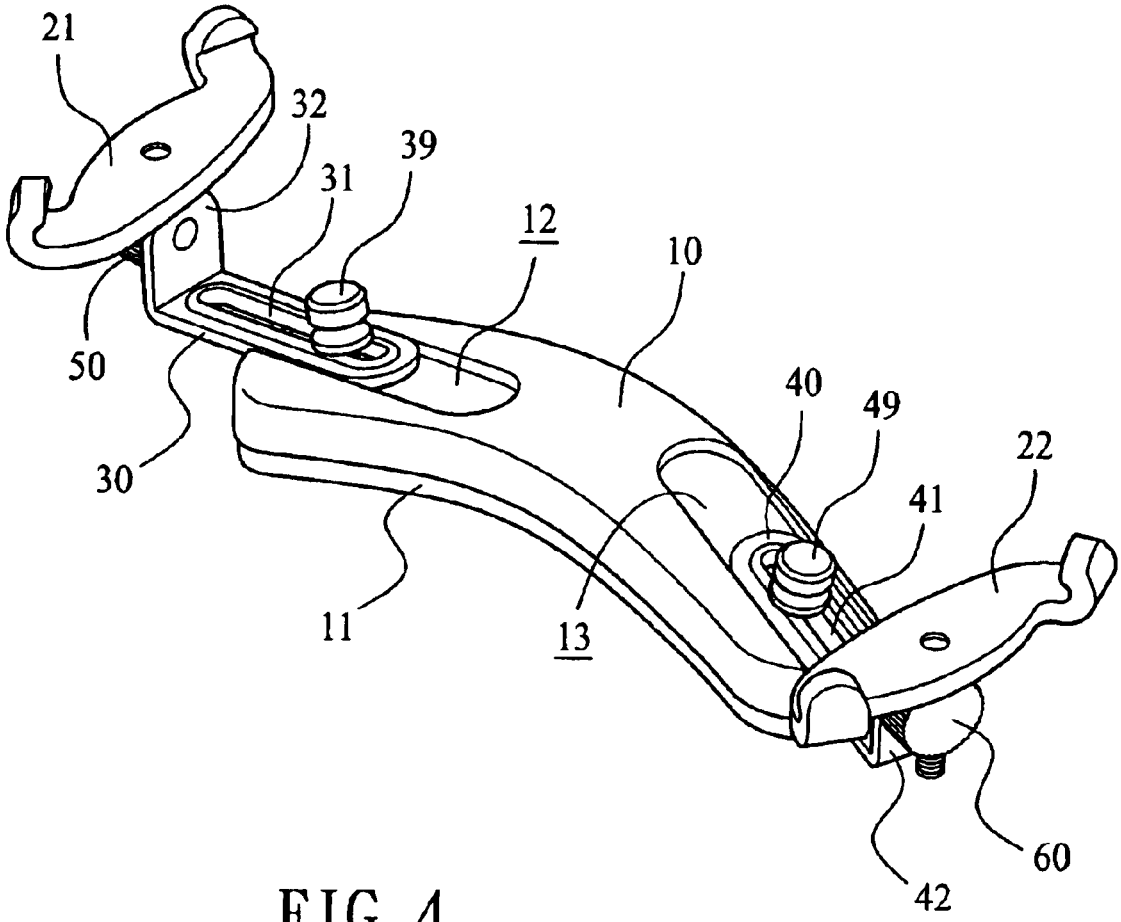
FIG. 4 shows two binding elements of the shoulder rest of FIG. 1 are horizontally adjusted to have an increased distance between them.
Figure 5:
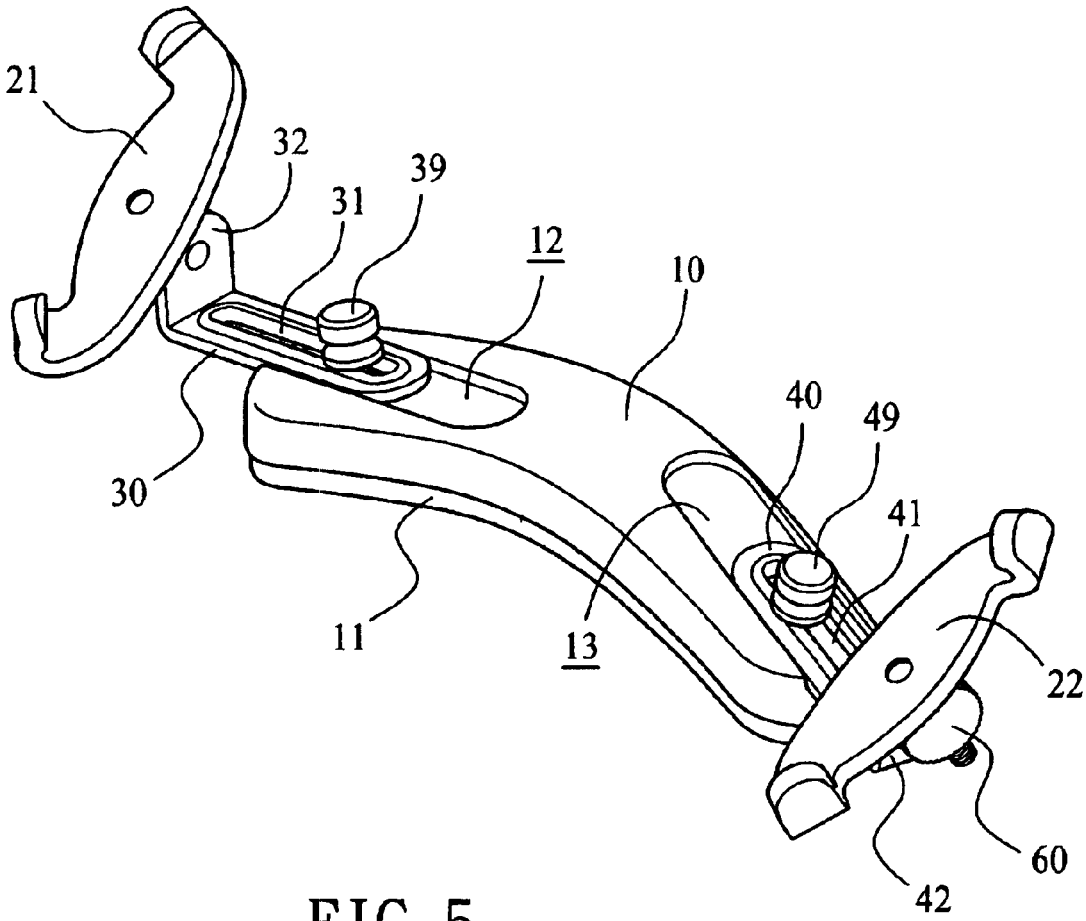
FIG. 5 shows the two binding elements of the shoulder rest of FIG. 4 are angularly adjusted to an inclined position relative to the shoulder rest.

Please refer to FIG. 4. After the two nuts 39, 49 are loosened, the two adjusting slides 30, 40 and the two binding elements 21, 22 connected thereto may be steplessly moved within the predetermined length of the recesses 12, 13. When the two adjusting slides 30, 40 and the binding elements 21, 22 connected thereto have been adjusted to desired positions, they are locked in place by tightening the two nuts 39, 49 again. More preferable, the binding elements 21, 22 may be angularly adjusted as shown in FIG. 5.

Therefore, the present invention not only allows stepless adjustment of the linear distance between the two binding elements of the shoulder rest for violin or the like, but also stepless adjustment of inclinations of the binding elements relative to the base of the shoulder rest when necessary. This enables the shoulder rest to be more fitly connected to the lower rear end of the violin and widely applied to various types of string instruments having different widths.

The present invention has been described with a preferred embodiment thereof and it is understood that many changes and modifications in the described embodiment can be carried out without departing from the scope and the spirit of the invention as defined by the appended claims.

What is claimed is:

1. A steplessly adjustable shoulder rest for violin, comprising:

a substantially elongated base made of a wooden material and having a layer of air-permeable soft pad fixedly attached to a lower surface thereof; said elongated base being provided at an upper surface with two oppositely spaced recesses that are separately extended from two outer ends of said base by a predetermined distance toward a central area of said base; and two guiding and locking bolts being separately provided in said recesses at positions in the vicinity of centers of said recesses but closer to outer ends thereof to vertically project from the upper surface of said base by a predetermined distance;

two adjusting slides, each of which having a horizontal main body provided with a long slot and adapted to flatly and slidably locate in one said recess on said elongated base with said guiding and locking bolt in said recess upward projected via said long slot, and outer ends of said horizontal main bodies being formed into two vertical end walls;

two nuts for screwing to or loosening from said guiding and locking bolts; and two binding elements separately connected to outer sides of said two adjusting slides to move along with said adjusting slides.

2. The steplessly adjustable shoulder rest for violin as claimed in claim 1, wherein one of said two recesses on the upper surface of said base is extended from one outer end of said base toward an inner edge of said base facing toward a player, and the other recess is extended from the other end of said base toward an outer edge of said base facing away from the player.

3. The steplessly adjustable shoulder rest for violin as claimed in claim 1, wherein said horizontal main bodies of said two adjusting slides have a length equal to the distance by which said recesses are extended from the outer ends of said base toward the central area thereof, and a thickness equal to a depth of said recesses.

4. The steplessly adjustable shoulder rest for violin as claimed in claim 1, wherein said vertical end walls of said two adjusting slides are separately formed at an outer side with a threaded hole for engaging with a rotational nut having a radial threaded hole provided thereon; and wherein said two binding elements are connected at respective downward extended screw bar to said radial threaded holes on said rotational nuts.

* * * * *